United States Patent [19]

Brien

[11] 4,115,995

[45] Sep. 26, 1978

[54] AUTOMATIC WRISTWATCH CONSTRUCTION

[76] Inventor: André Guy Brien, 3110 rue Germain, Fabreville, Canada

[21] Appl. No.: 724,283

[22] Filed: Sep. 20, 1976

[51] Int. Cl.[2] ..... G04C 3/00; G04C 9/00; G04C 19/00

[52] U.S. Cl. ..... 58/50 R; 58/23 R; 58/85.5; 200/52 R; 200/61.45 M; 200/61.52; 200/DIG. 29

[58] Field of Search ..... 58/23 R, 50 R, 85.5; 200/52 R, 61.45 M, 61.52, DIG. 29

[56] References Cited

U.S. PATENT DOCUMENTS

| | | | |
|---|---|---|---|
| 3,817,021 | 6/1974 | Bergey | 58/50 R |
| 3,921,108 | 11/1975 | O'Connor | 58/50 R X |
| 3,921,385 | 11/1975 | Harding et al. | 58/23 R |
| 3,935,701 | 2/1976 | Yamauchi et al. | 58/50 R |
| 3,939,640 | 2/1976 | Kahn | 58/23 R |
| 3,946,173 | 3/1976 | Haber | 200/52 R |
| 3,963,885 | 6/1976 | Brien | 200/52 R |
| 3,975,899 | 8/1976 | Haber | 58/23 R X |
| 4,003,197 | 1/1977 | Haber | 58/50 R |

*Primary Examiner*—Stanley J. Witkowski

[57] ABSTRACT

A wristwatch having a housing with an electronic digital visual display. A motion activated switch means is provided in the housing to reset the visual display to a desired display. The switch means has a first and a second switch function to cause a display of a predetermined digital display and to further cause activation and stoppage of the predetermined digital display to a desired one.

9 Claims, 4 Drawing Figures

AUTOMATIC WRISTWATCH CONSTRUCTION

BACKGROUND OF THE INVENTION (a) Field of the Invention

The present invention relates to a solid state wristwatch having a digital visual display and in which the display is adjusted automatically by motion activated switch means secured in the housing.

(b) Description of the Prior Art

With the advent of the solid state wristwatch, various additional features have been incorporated in wristwatches to obtain various time display functions or to illuminate the visual display. These functions, however, require activation and for this reason, it is required to provide additional pushbuttons or reset mechanical devices in the wristwatch casing. Thus, it is required to provide more cavities in the wristwatch casing to accommodate such mechanical adjustment devices and this makes the wristwatch less waterproof or dustproof. When water and dust enter such watches, it can affect the proper operation of the oscillating device and the solid state circuitry which programs the proper operation of the timepiece.

SUMMARY OF THE INVENTION

It is, therefore, a feature of the present invention to provide a wristwatch having no mechanical adjustment means external of the wristwatch housing and which is fully automatic.

It is a still further feature of the present invention to provide a wristwatch which is substantially waterproof and dustproof.

It is a still further feature of the present invention to provide a wristwatch having a digital visual display which is completely automatically adjustable.

A still further feature of the present invention is to provide a wristwatch having a motion activated switch means therein with two switch functions to cause a display of a predetermined digital display and to further cause activation and stoppage of the display at a desired value.

According to the above features, from a broad aspect, the present invention provides a wristwatch having a housing with an electronic digital visual display and a program electrical circuit means in said housing to operate said visual display, the improvement comprising motion activated switch means to reset said digital visual display to a desired digital value, said switch means comprising a first and second gravity activated switch, a switch contact in said first and second switch and connected to a respective function of said circuit means, said second switch when motion activated to cause a switch contact closure activating its respective function of said circuit means to permit a display of an actual digital value on said visual display, said first switch being motion activated in a first direction after said second switch to cause a switch contact closure activating its respective function of said circuit means to activate sequential display movement of said actual digital value selected by said second switch, said first switch being activated in a second direction to stop the activation of said sequential display movement to a desired value.

BRIEF DESCRIPTION OF DRAWINGS

The present invention will now be described with reference to the accompanying drawings in which.

DESCRIPTION OF PREFERRED EMBODIMENTS

Figure 1:
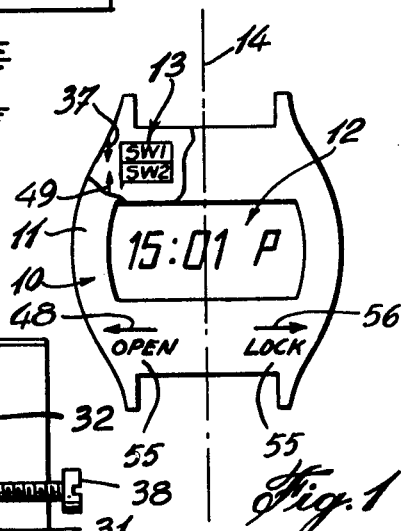
FIG. 1 is a front view of a wristwatch, partly fragmented, and having the motion activated switch means of the present invention.

Referring now to the drawings, and more particularly to FIG. 1, there is shown generally at 10, a solid state wristwatch having a housing 11 and a digital visual display 12 in a front face thereof. A motion activated switch means 13 is secured within the wristwatch housing 11 in a convenient location and in a specific alignment with respect to the 12–6 o'clock axis 14 thereof. The motion activated switch means 13 is operated by predetermined displacements of the casing 11 whereby to cause activation of the switch functions of the switch means. These will be described in detail later.

Figure 2:
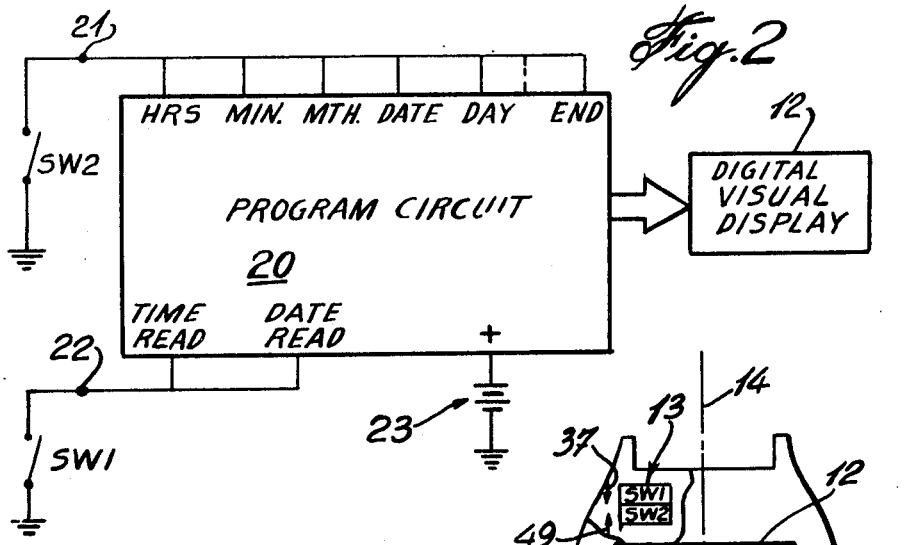
FIG. 2 is a block schematic illustration of a program electrical circuit as utilized in solid state watches.

Referring now to FIG. 2, there is shown a block diagram, representing a program electrical circuit 20 which is normally found in solid state watches. Such circuit usually consists of a single chip or a plurality of chips having integrated circuits to perform various program functions when activated in specific manners by means of switch buttons conventionally provided on the housing of the wristwatch. The program electrical circuit 20 does not form part of the present invention and, for that reason, a detailed schematic thereof is not shown. The present invention relates to the motion activated switch means which will cause activation of functions programmed in the program electrical circuit 20.

The program electrical circuit 20 hereinshown is provided with two program display functions which are triggered at inputs 21 and 22 respectively. These are triggered by switch closures of switch SW1 and SW2 constituting the motion activated switch means 13. A power cell 23 is also connected to the program electrical circuit 20 and interconnects with the inputs 21 and 22 within the circuit and in a manner not shown, whereby the program display functions are triggered and fed to the digital visual display 12.

Switch SW1 is connected to a first display function whereby when SW1 is activated, it will cause the time of day (HRS,MIN,) to be displayed on the digital visual display, which display will be sequentially operated. When SW1 is activated twice in succession, it will cause a display of the date, i.e., (MTH, DATE, DAY). When SW2 is closed, it will cause a stationary display of the actual hour on the digital visual display 12. When twice activated in succession, it will then display, also in a stationary manner, the minute of the day. With sequential operations of SW2, a stationary display of the month, the date, the day, etc., will be displayed. The last program switch function will display an end of function either by displaying a dot or a dash or other visual means on the digital visual display. This indicates that the program display function of switch SW2 will again begin when the next closure of switch SW2 arises.

Figure 3:
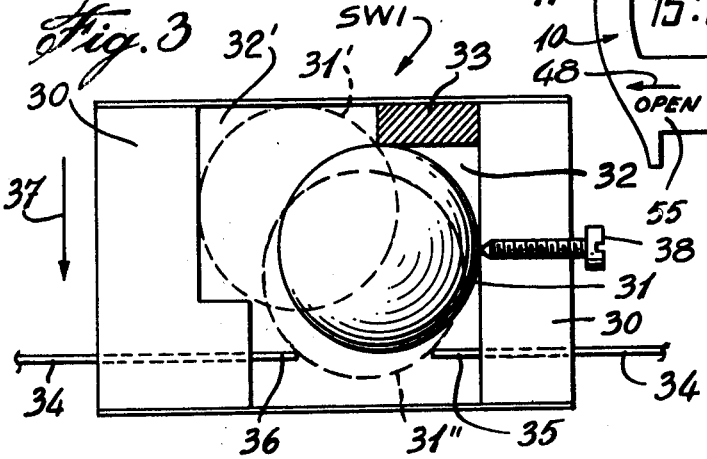
FIG. 3 is a sectional view of a first motion activated switch of the present invention.

Referring now to FIG. 3, there is shown the construction of the first switch SW1. Switch SW1 comprises a housing 30 having a spherical displaceable element 31 therein of magnetically attractable material.

The spherical element 31 is displaceable within a chamber 32. A small magnet 33 is secured at a convenient location within the chamber 32 and adjacent a pair of switch contact arms 34 having spaced apart contact points 35 and 36. The chamber 32 is dimensioned whereby the magnet 33 will retain the spherical element 31 spaced above the contact tips 35 and 36. A side cavity 32' is further provided to store the spherical element 31 in a position 31' further away from the switch contact tips 35 and 36 and in a close fit therein. It may be desirable to place the spherical element 31 in that position to prevent unncessary activation of the switch when the wearer is sleeping, for example. Therefore, the casing 11 is subjected to an abrupt displacement in the direction of arrow 48 (see FIG. 1) to lodge the element 41 in cavity 32'. In order to activate the switch to cause a switch closure between the contact tips 35 and 36, it is necessary to cause the switch housing 30 to displace itself in a quick snap motion along the direction of arrow 37 whereby to dislodge the spherical element 31 from its retention by the magnet 33 to assume the position as shown at 31''. Thus, a closed contact is formed between the contact tips 35 and 36 through the spherical element 31. An adjustment screw 38 may be provided in a wall of the housing 30 to adjust the sensitivity of the switch SW1 by causing more restricted movement of the spherical element 31 within the chamber 32. As soon as the switch housing is positioned in a plane tilted in opposition to arrow 37, the spherical element 31 will be displaced away from the contact tips 35, 36 by gravity and be immediately attracted to the magnet 33 where it will be retained thereby until the housing 30 is subjected to a further abrupt snap motion in the direction of arrow 37.

Figure 4:
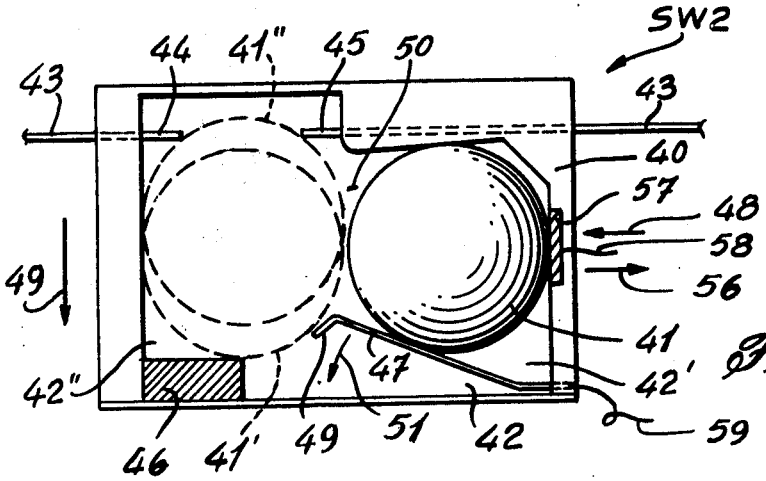
FIG. 4 is a sectional view of a second motion activated switch of the present invention.

Referring now to FIG. 4, there is shown the construction of the second switch SW2. Switch SW2 consists of a housing 40 having a spherical element 41 therein constructed of magnetically attractable material. Spherical element 41 is positioned within the chamber 42 defined within the housing 40 for restricted movement therein.

The chamber 42 is herein divided in two portions and namely, a storage portion 42' and an activation portion 42''. Each of these portions are located in a side-by-side relationship. A pair of electrical contacts 43 are provided in the housing 40 and positioned to locate their contact tips 44 and 45 in a spaced apart manner adjacent an end of the activation portion 42'' of the chamber 42. At the adjacent end of the activation portion 42'', there is provided a magnet 46 to retain the spherical element 41 thereagainst. The spherical element 41 is retained in the storage portion 42' of the chamber 42 by means of a displaceable retaining leaf spring 47.

In its inoperative condition, the spherical element 41 is normally in the storage portion 42' of the chamber 42. In order to place switch SW2 in an operative condition, it is necessary to subject the switch housing 40 to a quick snap motion in the direction of arrow 48. This causes the spherical element 41 to "shoot out" of the storage portion 42' due to gravity and pressure exerted on the spring 42 by the spherical element 41 in the direction of arrow 48. The spherical element 41 is then immediately attracted by the magnet 46 to assume its position as illustrated at 41'. By subjecting the switch casing 40 to a further snap motion in the direction of arrow 49, the spherical element 41 is then displaced from its position at 41' to its position at 41'' where a switch closure is effected through the contact tips 44 and 45 via the spherical element at position 41''. In order to cause an open switch contact, it is thus necessary to tilt the casing 40 in a direction opposite to arrow 49 whereby the spherical element 41 will fall by gravity from its position at 41'' to its position at 41' where it is retained by the magnet 46. Thus, every time the switch casing is moved in the direction of arrow 49, and in a snap motion, it will dislodge the spherical element 41 from the magnet 46 and cause a switch closure. The switch closure is then easily opened by tilting the switch housing 40 in a smooth motion and in the direction opposite to arrow 49.

In order to then displace the spherical element 41 from the activation portion 42'' of the chamber 42 to its storage portion 42', it is necessary to effect an abrupt motion of the casing 40 in a direction 56 opposite to that of arrow 48. As can be seen from FIG. 4, the end 49 of the displaceable spring 47 is bent outwardly in a direction away from the throat portion 50 of the storage portion 42' whereby the spherical element 41 will engage it and cause the spring 47 to bend in the direction of arrow 51, by the force exerted by the spherical element 41, to permit the spherical element to assume its initial storage position as shown at 41.

Having thus described the construction of switches SW1 and SW2 which constitutes the motion activated switch means 13, we will now describe their positioning in the wristwatch housing 11. As shown in FIG. 1, the switches are positioned relative to the housing 11 whereby the direction of activation thereof, as represented by arrows 37 and 49, lie in substantial parallel alignment with the 12–6 o'clock axis 14 of the watch 10. Also, on the face of the wristwatch 10 or on the back thereof, there can be provided instructions such as at 55 indicating the direction that the switch housing must be displaced abruptly in order to cause an opening or to lock switch SW2. It is to be understood that with solid state watches, adjustment thereof is not frequently required as such watches are very accurate. Therefore, the operation of SW2 will not often be required and for this reason, the spherical element 41 is strongly retained within the storage portion 42' of the chamber 42 by the spring 47. Thus, the strength of the spring 47 can be selected to require a much stronger force to dislodge the spherical element 41 from its storage position. This is preferred in order to prevent unwanted switch closure of SW2.

In operation, when it is required to display the time of day, it is only necessary to displace the wearer's wrist in a snap motion in the direction of arrow 37. This causes spherical element 31 to locate itself against the tip contacts 35 and 36 giving a first switch signal to the program electrical circuit causing the TIME READ function to be activated. This will give a display of the hours, minutes and seconds, in sequential operation. By turning the wearer's wrist in a direction opposite to arrow 37, the spherical element 31 will resume its position against magnet 33. By effecting two quick successive wrist movements in the direction of arrow 37, and within a predetermined programmed time, a second switch contact closure will be detected by the program electrical circuit to cause the DATE READ function to be displayed on the visual display 12. This would give a display of the month, date and day. By again turning the wearer's wrist in a direction opposite to arrow 37, the display will be terminated. Of course, the program circuit may have other program functions which would be activated by three or more quick successive wrist movements as described above.

When it is necessary to reset the visual display to a desired display, for example, when it is required to reset the time, it is then necessary to subject the wristwatch housing 11 to an abrupt motion in the direction of arrow 48. This will dislodge the spherical element 41 from its storage portion in the chamber 42 to its activation portion. This can be done by removing the watch from the wearer's wrist and striking the casing in the palm of the hand in the direction of arrow 48. Switch SW2 is then in an activation condition. By then displacing the casing in a quick snap motion in the direction of arrow 49, a first switch closure of switch SW2 will occur as the spherical element 42 will be displaced to the position as shown at 41″. This switch closure will cause the HRS function of the program electrical circuit to be displayed on the visual display 12. This display is a stationary display. In order to trigger the stationary display into a sequential display, it is then necessary to activate swtich SW1 in the direction of arrow 37, as previously described. This will cause the stationary display to go into a sequential display. Once a desired hour display appears, it is then only necessary to tilt the housing in a direction opposite to the direction of arrow 37 to stop the sequential operation of the HRS function. Thus, the desired HRS function is set. If it is then necessary to reset the DAY function, then it is necessary to cause the four more successive operations of switch SW2 whereby to cause the program function to go through its sequential operation and namely, HRS, MIN, MTH, DATE, and finally, DAY. The alphanumeric display of the proper day is then effected by causing a switch closure of SW1 and opening SW1 when the desired day appears. SW2 is then again activated until it reaches its END function indicating that the program stationary display function is now ready to repeat from the beginning. The spherical element 41 of switch SW2 is then inserted back to its storage position by subjecting the casing to an abrupt displacement in the direction of arrow 56, forcing the spherical element 41 to its storage portion 42′.

As shown in FIG. 4, a contact element 57 may be provided in the wall of the storage portion 42′ of chamber 42 for contact with the spherical element 41. An indicator lamp (not shown) connected in an electrical circuit between wire 58 secured to contact element 57 and to wire 59 secured to spring 47 would indicate the presence of the spherical element 41 in the portion 42′. This would provide a means to verify that SW2 is inactive.

It is within the ambit of this invention to cover other obvious modifications of the embodiment disclosed. For example, it is conceivable that both switch functions could be activated in the same direction, provided the program circuit is programmed to detect the order of switch closures between both switches. The magnet of SW2 could be selected to automatically attract the spherical element 42 thereto once it is displaced to effect a switch closure between the contact points 44 and 45.

I claim:

1. In a wristwatch having a housing with an electronic digital visual display and a program electrical circuit means in said housing to operate said visual display, the improvement comprising motion activated switch means to reset said digital visual display to a desired digital value, said switch means comprising a first and second gravity activated switch, a switch contact in said first and second switch and connected to a respective function of said circuit means, said second switch when motion activated to cause a switch contact closure activating its respective function of said circuit means to permit a display of an actual digital value on said visual display, said first switch being motion activated in a first direction after said second switch to cause a switch contact closure activating its respective function of said circuit means to activate sequential display movement of said actual digital value selected by said second switch, said first switch being activated in a second direction to stop the activation of said sequential display movement to a desired value.

2. A wristwatch as claimed in claim 1 wherein said housing is a sealed housing with said circuit means and switch means being secured therein, there being no mechanical adjustment means extending through said switch housing to set the time display or to light said display or to perform other adjustments of said display.

3. A wristwatch as claimed in claim 2 wherein said first switch is connected to a sequential activation read display function of said circuit means, said second switch being connected to a programmed stationary read display function.

4. A wristwatch as claimed in claim 3 wherein said second switch is lockable to prevent activation of said programmed stationary read display function.

5. A wristwatch as claimed in claim 3 wherein said first and second switch each have a housing, said first switch housing having a displaceable element of magnetically attractable material for restricted movement in said first switch housing, a pair of electrical contacts in said first switch housing constituting said switch contact, a magnet in said first switch housing for retaining said displaceable element thereagainst and spaced from said electrical contacts, said displaceable element being dislodged from said magnet by a predetermined motion of said switch housing to cause a switch closure between said pair of electrical contacts.

6. A wristwatch as claimed in claim 3 wherein said first and second switch each have a housing, said second switch housing having a displaceable element of magnetically attractable material for restricted movement in said second switch housing, a pair of electrical contacts in said second switch housing constituting said switch contact, a magnet in said second switch housing for retaining said displaceable element thereagainst and spaced from said electrical contacts when in a first part of said second switch housing, said displaceable element being dislodged from said magnet by a first predetermined motion of said second switch housing to cause a switch closure between said pair of electrical contacts, said displaceable element being displaced to a second part of said second switch housing by a second predetermined motion of said second switch housing, said displaceable element being retained in said second part of said second switch housing.

7. A wristwatch as claimed in claim 6 wherein a retaining leaf spring is positioned and secured in said second switch housing to retain said displaceable element in said second part of said second switch housing.

8. A wristwatch as claimed in claim 7 wherein said displaceable element is displaceable to said second part of said second switch housing by a displacement of said housing in a plane transverse to a motion causing said displaceable element to move from said magnet to said electrical contacts.

9. A wristwatch as claimed in claim 8 wherein said magnet is secured opposite to said switch contacts, said second part of said second switch housing being located to a side of a displacement axis of said displaceable element between said magnet and said switch contacts.

* * * * *